United States Patent [19]

Dudley

[11] 4,355,744

[45] Oct. 26, 1982

[54] PORTABLE BOOTJACK

[76] Inventor: Robert A. Dudley, 385 Reagan Pl., Fallon, Nev. 89406

[21] Appl. No.: 196,340

[22] Filed: Oct. 14, 1980

[51] Int. Cl.[3] ..... A47J 51/02

[52] U.S. Cl. ..... 223/114; 223/115

[58] Field of Search ..... 223/114, 115, 113, 116, 223/117

[56] References Cited

U.S. PATENT DOCUMENTS

| | | | |
|---|---|---|---|
| 54,948 | 5/1866 | Pierpont | 223/115 |
| 147,069 | 2/1874 | Sawyer et al. | 223/114 |
| 209,091 | 10/1878 | Tyson | 223/114 |
| 960,148 | 5/1910 | Bancroft | 223/114 |
| 1,293,318 | 2/1919 | La Boissiere et al. | 223/113 |
| 1,893,280 | 1/1933 | Gerfen | 223/115 |
| 2,408,640 | 10/1946 | Hilton | 223/115 |
| 3,734,364 | 5/1973 | Mayer | 223/116 |

FOREIGN PATENT DOCUMENTS

| | | | |
|---|---|---|---|
| 625787 | 12/1933 | Fed. Rep. of Germany | 223/115 |

*Primary Examiner*—Louis Rimrodt

*Attorney, Agent, or Firm*—Blair, Brown & Kreten

[57] ABSTRACT

A portable bootjack which includes a substantially planar body formed from a metal rod bent into a U-shaped configuration to form a yoke at the front end for the heel of a boot and having U-shaped leg portions extending longitudinally and rearwardly from the yoke on either side to form a platform with the leg portions connected together by longitudinally spaced cross members and a U-shaped leg pivotally connected to one of the cross members for movement between a folded position under the body and a downwardly extending position against a further cross member to position the body in an inclined position on a supporting surface.

8 Claims, 2 Drawing Figures

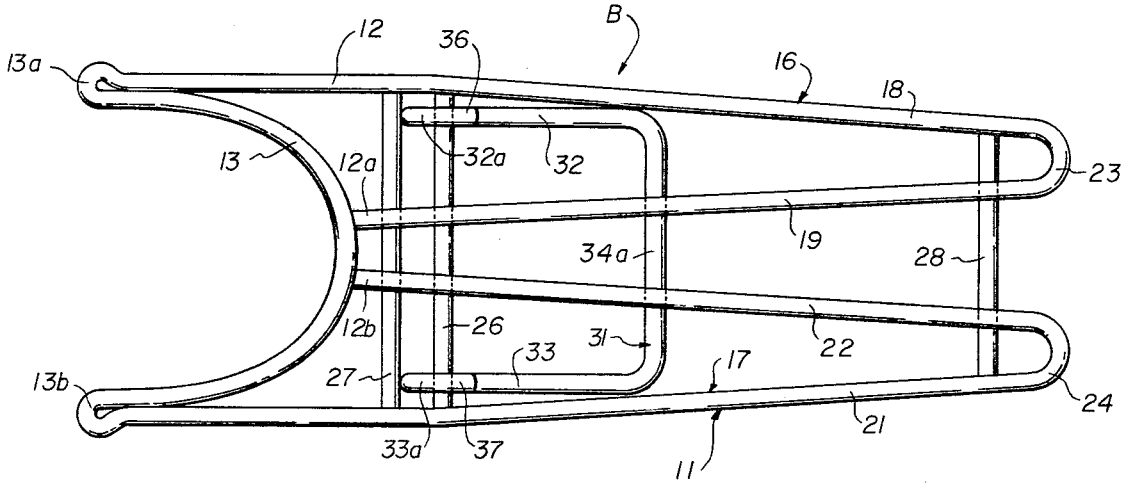
FIG 1
FIG 2
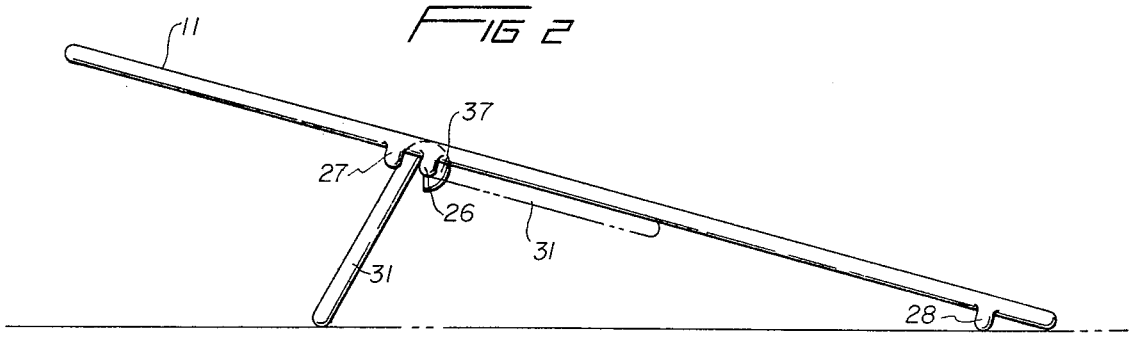

PORTABLE BOOTJACK

BACKGROUND OF THE INVENTION

A common device in use today for facilitating the removal of boots such as riding boots, western boots and the like is the device referred to as a "bootjack." Such bootjacks generally include a flat portion against which one boot of the user is pressed and a recess at the forward end for accommodating the heel of the boot of the other foot for removal of the boot. The underside of the bootjack is provided with a downwardly depending support or leg which supports the bootjack in an incline position on a supporting surface for ready removal of the boot. Present day bootjacks are usually made of wood and of solid construction so that they are expensive, relatively fragile and quite bulky imposing certain limitations on storage and portability particularly when the support or leg is rigidly attached to the upper portion of the bootjack. Furthermore, in order to avoid scuffing or similar damage to the boot heel during the removal of the boot the recess in the bootjack is generally provided with a suitable padding or the like adding to the cost of the bootjack. In addition, such present day bootjacks are easily damaged due to the rough use to which they are subjected and as a result of prolonged wear and tear have a relatively short useful life.

The following patents are representative of the prior art to which the subject invention is directed:

| Patent No. | Inventor |
|---|---|
| 3,734,364 | Mayer |
| 1,893,280 | Gerfen |
| 147,069 | Sawyer et al |
| 1,293,318 | La Boissiere et al |

None of the prior art patents referred to above are similar in construction to that of the subject invention. The Hilton patent relates to a combined bootjack and boot hook wherein two wire members are detachably interconnected to provide both a bootjack and a boot hook. The La Boissiere et al patent also refers to a combination bootjack and boot hook. The Sawyer et al patent refers to a bootjack in which a hinged platform is provided wherein a platform of sheet metal is disposed across a wire member bent to form a ledge and a smaller belt. The Gerfen patent relates to a foldable bootjack in which two portions of the bootjack are hingedly interconnected intermediate the ends folded from an overlying relationship into an extended relationship. Similarly, the Mirski patent refers to a combination bootjack and boot hook device containing two hingedly interconnected parts one for receiving the heel and the other part suitable for use both as part of the bootjack and as a boot hook. The Mayer patent shows a collapsible bootjack formed of wood or the like having a solid body and a support formed of two hingedly connecting plates which may be moved between a collapsed storage position within the upper plate and a downwardly extending plate supporting position.

OBJECTS AND SUMMARY OF THE INVENTION

Accordingly, a primary object of this invention is to provide a new and novel bootjack which is extremely simple and inexpensive in construction and which is formed entirely of a metal rod.

Another object of this invention is to provide a new and novel bootjack which is extremely compact and which may be folded into a substantially flat position so as to be easily carried or stored in an inconspicuous manner and in a relatively small space.

A further object of this invention is to provide a new and novel bootjack which may be manufactured from relatively inexpensive material with a high production rate and at a very low initial cost.

A still further object of this invention is to provide a new and novel bootjack which includes a retractable stand for positioning the bootjack in an operative boot removing position and which is capable of prolonged use without deterioration either from wear or tear or by exposure to the elements.

The objects of the invention and other related objects are accomplished by the provision of a substantially planar body formed from a metal rod having free ends with a portion intermediate the ends bent into a forwardly opening U-shaped configuration to define a yoke for receiving the heel of the boot to be removed. The metal rod of the body also includes longitudinally extending leg portions of U-shaped configuration extending between the yoke and the free ends to define a platform for pressing engagement by the foot of a user and a plurality of longitudinally spaced, transversely extending cross members are formed also from a metal rod and are secured to these rod portions. A leg member also formed of a metal rod is pivotally mounted on one of the cross members for movement between an operative folded position in underlying, substantially parallel relationship with the body and a downwardly extending operative position against another one of the cross members for supporting the body in an angularly disposed relationship on a supporting surface.

Further objects and benefits will become evident when considering the following detailed specification when taken in conjunction with the appended drawing figures.

BRIEF DESCRIPTION OF THE DRAWINGS

FIG. 1 is a plan view of the bootjack constructed in accordance with the invention shown in a folded position; and FIG. 2 is a side elevation view of the bootjack of the invention shown in the operative position.

DESCRIPTION OF THE PREFERRED EMBODIMENT

Referring now to the drawing wherein like reference numerals indicate like parts, there is shown a bootjack constructed in accordance with the invention and designated generally by the letter B. The bootjack B includes a substantially planar body designated generally by the reference numeral 11 formed from a metal rod 12 having free ends 12*a*, 12*b*. The metal rod 12 may be formed from any suitable steel rod or the like and may be provided with a suitable protective coating such as a galvanized coating, a metallic dip or the like.

The metal rod 12 is bent intermediate the free ends 12*a*, 12*b* into a forwardly opening U-shaped configuration defining a yoke 13 for receiving the heel of a boot to be removed in the well known manner. The metal rod 12 is bent back upon itself at the upper ends 13*a*, 13*b* of the yoke 13 and extends rearwardly on each side where it is configured into a pair of longitudinally extending rod portions designated generally by the reference numerals 16, 17 disposed in side-by-side relationship on opposite sides of the body 11.

Each of the longitudinally extending leg portions 16, 17 include a pair of legs 18, 19 and 21, 22 and bight portions 23, 24 at the rear of the body 11. The outer legs 18, 21 form the marginal side edges of the body 11 and the inner legs 19, 22 are disposed therebetween with the free ends 12*a*, 12*b* secured by suitable means such as welding to the portion of the rod 12 forming the yoke 13.

The bootjack B also includes a plurality of longitudinally spaced, transversely extending cross members preferably formed from a metal rod which include a first cross member 26, a second cross member 27 and a third cross member 28 disposed adjacent the bight portions 23, 24 of the leg portions 16, 17 adjacent the rear of the body 11. In the preferred embodiment, the cross members 26-28 are secured by welding or the like to the underside of the leg portions 16, 17 and are disposed in substantially parallel relationship with the first and second cross members 26, 27 arranged in closely spaced apart relationship. As can be seen, the body 11 is therefore substantially planar in construction to form a platform for pressing engagement by the boot on the foot of a user.

The bootjack B of the invention includes a leg member designated generally by the numeral 31 of U-shaped configuration having legs 32, 33 and a bight portion 34*a* with the legs 32, 33 being provided with free ends 32*a*, 33*a* respectively. The leg member 31 is also preferably formed from a metal rod or the like similar to the metal rod 12 and means are provided for pivotally mounting leg member 31 on one of the cross members such as the first cross member 26. More specifically, each of the free ends 32*a*, 33*a*, of the legs 32, 33 respectively of the leg 31 is shaped into the form of a loop 36, 37 respectively for accommodating the first cross member 26 so that the leg 31 is pivotally movable between an inoperative folded position in underlying, substantially parallel relationship with the body 11 as shown in FIG. 1 and a downwardly extending operative position with the legs 32, 33 against the second cross member 27 for supporting the body 11 in an angularly disposed relationship with a supporting surface such as a floor or the like as shown in FIG. 2. In FIG. 2, the leg 31 is shown in broken lines in the folded position and in solid lines in the extended position.

It can easily be seen that the simple and inexpensive construction of the invention utilizing only a metal rod, a highly durable and virtually indestructable bootjack is provided and the manufacturing of such a bootjack B is accomplished in a simple and easy manner by a minimum of rod bending and welding operations. In the folded condition of the bootjack B as shown in FIG. 1, the bootjack B may be easily stored or transported such as in the pocket of a user or in other suitable case or the like and the leg 31 is easily flipped into the operative position as shown in solid lines in FIG. 2 to provide a very sturdy platform for supports for removal of the boots of a wearer. The leg 31 is attached in a permanent manner to the bootjack body 11 and regardless of the number of uses, there is virtually no wear or deformation encountered in any of the parts of the bootjack B regardless of the number of uses.

Having thus described the invention, it should be apparent that numerous structural modifications are contemplated as being a part of this invention as set forth hereinabove and as defined hereinbelow by the claims.

What is claimed is:

1. A portable bootjack comprising, in combination, a substantially planar body forward from a metal rod having free ends, said rod having a formed portion adjacent said free ends defining a forwardly opening, U-shaped configured yoke for receiving a boot heel and having longitudinally extending portions rearwardly said yoke and about and beyond said free ends disposed in side-by-side relationship and terminating with said free ends fixed to a bight portion of said yoke defining a platform for pressing engagement by the foot of a user, a plurality of longitudinally spaced, transversely extending cross members formed from a metal rod secured to said longitudinally extending rod portions, and a leg member formed from a metal rod pivotally mounted on a first one of said cross members for movement between an inoperative folded position in underlying, substantially parallel relationship with said body and a downwardly extending, operative position abutting against a second one of said cross members for supporting said body in an angularly disposed relationship with a supporting surface.

2. A bootjack in accordance with claim 1 wherein said leg member is of U-shaped configuration having transversely spaced free ends and means for pivotally connecting said leg member free ends to said first one of said cross members.

3. A bootjack in accordance with claim 2 wherein said means for pivotally connecting said leg member free ends to said first one of said cross members comprises a looped formed in each of said leg member free ends to provide an eye for accommodating said first one of said cross members.

4. A bootjack in accordance with claim 3 wherein said first and second ones of said cross members are disposed on said body and longitudinally closely spaced, substantially parallel relationship for accommodating said eyes and wherein said legs are arranged to engage by abutting said second one of said cross members in said operative position.

5. A bootjack in accordance with claim 4 wherein each of said longitudinally extending rod portions are of U-shaped configuration including an outer leg, an inner leg and a bight portion defining the rear of said body, said outer legs forming the marginal side edges of said body with said inner legs being disposed therebetween.

6. A bootjack in accordance with claim 5 including a weld for fixing said free ends of said metal rod forming said body to said yoke.

7. A bootjack in accordance with claim 6 wherein said plurality of cross members include a third one of said cross members secured to said longitudinally extending rod portions of said body adjacent said bight portions at the rear of said body.

8. A bootjack in accordance with claim 7 wherein said plurality of cross members are secured to said longitudinally extending rod portions in underlying relationship therewith.

* * * * *